United States Patent [19]

Martin, III

[11] Patent Number: 5,001,443

[45] Date of Patent: Mar. 19, 1991

[54] COAXIAL-WAVEGUIDE ASSEMBLAGES

[75] Inventor: James N. Martin, III, Cedar Knolls, N.J.

[73] Assignee: AT&T Bell Laboratories, Murray Hill, N.J.

[21] Appl. No.: 473,770

[22] Filed: Feb. 2, 1990

[51] Int. Cl.[5] ..... H01P 5/103

[52] U.S. Cl. ..... 333/26; 333/125; 333/260; 439/581; 439/582

[58] Field of Search ..... 333/125, 127, 136, 137, 333/26, 254, 260; 439/578–585

[56] References Cited

U.S. PATENT DOCUMENTS

| | | | |
|---|---|---|---|
| 2,225,728 | 12/1940 | Weidenman . | |
| 2,332,529 | 10/1943 | Reppert . | |
| 2,966,645 | 12/1960 | Bird et al. | 333/260 |
| 3,258,735 | 6/1966 | Valle . | |
| 3,275,970 | 9/1966 | Johanson et al. . | |
| 3,539,966 | 11/1970 | Logan . | |
| 4,396,242 | 8/1983 | Kurano et al. . | |
| 4,684,874 | 8/1987 | Swift et al. | 333/125 |
| 4,724,400 | 2/1988 | Luettgenau | 330/295 |
| 4,912,428 | 3/1990 | Shen et al. | 333/260 |

*Primary Examiner*—Paul Gensler

*Attorney, Agent, or Firm*—R. F. Kip, Jr.

[57] ABSTRACT

Coaxial units are disclosed for conducting microwaves to and from amplifying apparatus with splitter and combiner cavities. Each coaxial unit comprises an outer conductor, a dielectric sleeve having an unsheathed portion extending forward of the front end of the outer conductor, and an inner conductor pin projecting forward of the sleeve, the pin having a forward portion which is resiliently compressible radially inward. The coaxial unit is coupled to an associated cavity by having its sleeve and pin forward portions, respectively, received in large and small bores respectively formed in metallic plates on opposite sides of the associated cavity. The forward portion of the pin makes direct yieldable-pressure electrical contact with metallic regions around the wall of the small bore at a location adjacent the opening of such bore into the cavity.

4 Claims, 5 Drawing Sheets

COAXIAL-WAVEGUIDE ASSEMBLAGES

TECHNICAL FIELD

This invention relates generally to assemblages of components comprising a coaxial coupler unit and microwave confining means permitting propagation therein of high frequency electromagnetic wave energy, such assemblages being adapted to effect transfer of such energy from one to the other of such components. More particularly, this invention relates to assemblages of such kind adapted for use in apparatus comprising splitter and combiner cavities and multiple r.f. amplifiers connected in parallel between these cavities (a splitter-combiner apparatus), and in which a coaxial coupler unit of such an assemblage is at the input port and/or the output port of such apparatus.

BACKGROUND OF THE INVENTION

On Feb. 9, 1988, U.S. Pat. No. 4,724,400, entitled "Linear Amplifier Assembly" was issued in the name of G. G. Luettgenau to TRW Inc. (the "400 patent"). Such patent is treated herein solely as a publication. The disclosure of the '400 patent as a publication is, however incorporated herein by reference and made a part hereof.

The '400 patent shows and describes a microwave splitter-combiner apparatus comprising a cylindrical stack of vertically superposed circular metallic plates defining within the stack an upper splitter waveguide and a lower combiner waveguide. Each such waveguide comprises a pair of vertically spaced metallic walls and a chamber between and bounded by such walls and providing a passage through which microwaves propagate, the chamber being essentially in the form of a horizontal cylindrical disc. In the splitter waveguide, the microwaves travel through its cylindrical disc chamber from its center radially outward while, in the combiner waveguide, such travel in its chamber is radially inward towards the center of the chamber.

Disposed on a plate member providing a top closure for the mentioned stack is a set of twenty r.f. amplifier operating units each essentially in the shape of a rectangular block. The twenty units are equiangularly spaced in carousel fashion around the top of such member in respective radial planes which are vertical and pass through the vertical axis of the stack.

Each of such twenty r.f. amplifier units is coupled to the splitter waveguide by an input coaxial connector and to the combiner waveguide by an output coaxial connector. In the operation of the apparatus, high frequency electromagnetic energy is fed to the splitter waveguide's center, travels therefrom radially outward through the waveguide's chamber to the twenty input connectors and is then fed upward by them to the twenty amplifiers which operate in parallel to amplify such energy. The amplified energy is then fed via the twenty output connectors to points in the combiner waveguide's chamber which are radially outward of the chamber's center. From those points the energy travels as waves radially inward through the chamber to its center to there be combined and provide an amplified output from the apparatus.

In the apparatus of the '400 patent, the input microwave energy is supplied to a splitter cavity via an input coupling unit described in that patent as a coaxial type connector and the amplified microwave energy is tapped off from the combiner cavity by another similarly described coupling unit. Both such connectors are best depicted in FIG. 5*a* of the patent, and the center conductor of each of such type connectors is shown in that figure as being of constant diameter and having its front received in a constant diameter hole formed in one of the metallic cavity-bounding plates.

Beyond stating that the center conductor of the output connector touches and makes electrical contact with the metallic plate providing the hole in which that conductor is received, the '400 patent does not disclose any of the details of how electrical contact is made in the apparatus shown thereby between the center conductors of the input and output connectors and the metallic plates in which such conductors are received. The inventor knows, however, how such electrical contacts were made in accordance with the practice of the prior art as represented by the '400 patent.

Specifically, the front end of the center conductor of each connector was received in a hole formed in the receptacle plate and of greater diameter than the conductor. An electroconductive epoxy resin was then introduced in the hole into the interstice between the conductor and the hole wall. The epoxy was then cured by heating the entire apparatus in an oven. Such procedure had the disadvantages, however, that proper curing of the epoxy required about an hour of heating and that, all during such heating, care had to be taken to maintain the proper alignment of the conductor relative to the hole.

SUMMARY OF THE INVENTION

These and other disadvantages are obviated according to the invention in one of its aspects by providing coaxial coupling units which, for the most part, are of the SMA and N types, but of which the projecting pin of the unit has a forward portion which is resiliently compressible radially inward by passage of that portion through an opening of a hole extending at least part way through receptacle means, and having a diameter at such opening less than that of such forward portion when compressed. The unit is adapted to be employed with waveguide means comprising first and second vertically spaced metallic wall means bounding opposite sides of a wave propagation space providing for horizontal passage between such two wall means of high frequency electromagnetic wave energy, such first and second wall means having respectively formed therein relatively large and small vertical coaxial holes of which the large holes pass through said first means to said space, and the small hole extends from such space at least part way through such second means, such small hole having an opening into such space which is of smaller diameter than that of the mentioned forward portion of the pin. The coaxial coupler unit is used in conjunction with such waveguide means by positioning of a forward part of the unit into the vertical passage defined by such holes so that the resiliently compressible forward portion of the pin of the unit is passed through such opening of the small hole and into such hole itself to be compressed by such passage and to make pressure electromechanical contact at that opening with the second metallic wall means. By providing for the making in such fashion of electrical contact between the pin of the unit and such metallic wall means, the heretofore mentioned disadvantages of the prior art practice are eliminated.

BRIEF DESCRIPTION OF THE DRAWING

For a better understanding of the invention, reference is made to the following description of an exemplary embodiment thereof and to the accompanying drawings wherein.

DETAILED DESCRIPTION

Figure 1:
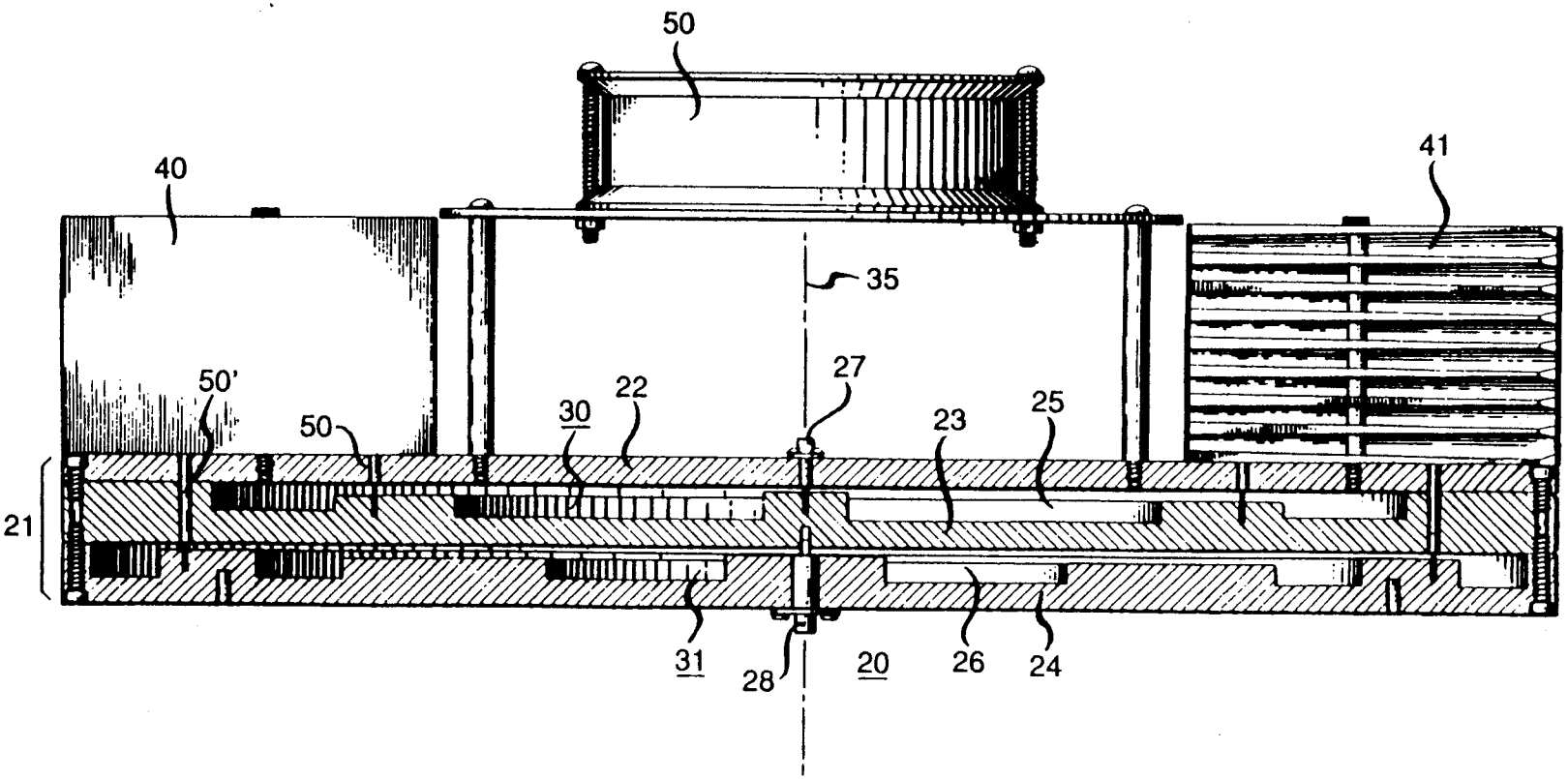
FIG. 1 is front elevational cross-sectional schematic view of a splitter-combiner apparatus incorporating coaxial coupling units according to the invention and other assemblages according thereto.

Referring now to FIG. 1, the reference numeral 20 designates a splitter-combiner and amplifying apparatus comprising a circular cylindrical vertical stack 21 of superposed, circular, aluminum horizontally-disposed plate members all at d.c. ground and constituting an upper member 22, a middle member 23 and a lower member 24. While the bottom of member 22 is planar, the confronting top of member 23 is selectively inwardly recessed as shown to define between the members a chamber 25 containing a dielectric material (e.g., air) and in the form of a cylindrical disc. The chamber 25 is bounded on its vertically opposite sides and around its periphery by two metallic wall means provided by the portions adjacent to the chamber of members 22, 23, and such metallic wall means, together with chamber 25, constitute an upper splitter cavity or waveguide 30 adapted to receive high frequency electromagnetic energy via a coaxial input terminal 27 at the waveguide's radial center. Similarly, there is defined between the members 23 and 24 a cylindrical disc chamber 26 which is bounded by two metallic wall means provided by portions of such members, and which chamber, together with the latter two wall means, constitutes a lower combiner cavity or waveguide 31 adapted to provide an output of high power, high frequency electromagnetic energy via an output coaxial-terminal 28 at the radial center of the combiner waveguide.

Upper member 22 supports on its top a ring of twenty r.f. amplifier modules equiangularly spaced around that member. Each such module comprises a housing and, within that housing, the amplifier's operating unit which has the overall structure of a thin rectangular block. FIG. 1 shows, in respect of the amplifier modules mounted on stack 21, only the amplifier block 40 of the most leftward amplifier module and the housing 41 of the most rightward amplifier module. Block 40 is (like the blocks of the nineteen other amplifier modules) disposed in relation to the stack 21 on which it is mounted to lie in a plane which contains the vertical axis 35 of the stack and is, thus, a radial plane therefor. Block 40 projects upward from stack 21 like a fin.

The amplifier block 40 is supplied from splitter waveguide 30 with high frequency electrical energy at 869–896 MHz via an input coaxial coupling unit 50, and such block in turn provides a supply of such energy as amplified to the combiner waveguide 31 via an output coaxial coupling unit 50'. Those two coupling units may be the same as or similar to the corresponding coupling units disclosed in U.S. Pat. No. 4,967,168, issued Oct. 30, 1990 in the name of Edward V. Bacher and Robert E. Myer for "Coaxial-Wave Guide Coupling Assemblages" and assigned to the assignee hereof. Such application is incorporated herein by reference and made a part hereof.

The operation of the FIG. 1 apparatus will be apparent from the description already given. Briefly, high frequency electromagnetic wave energy is supplied via terminal 27 to splitter waveguide 30 to be distributed within it to the twenty input coaxial coupling units for the twenty amplifiers of the apparatus. The fraction of that energy distributed to coupling unit 50 is transmitted by it to the corresponding r.f. amplifier unit 40 within which the energy is amplified. That amplified energy is subsequently piped by coaxial unit 50' to combiner waveguide 31 in which it is combined with the energy from the other r.f. amplifiers, and the combined energy is then tapped from that waveguide at its output terminal 28.

Figure 2:
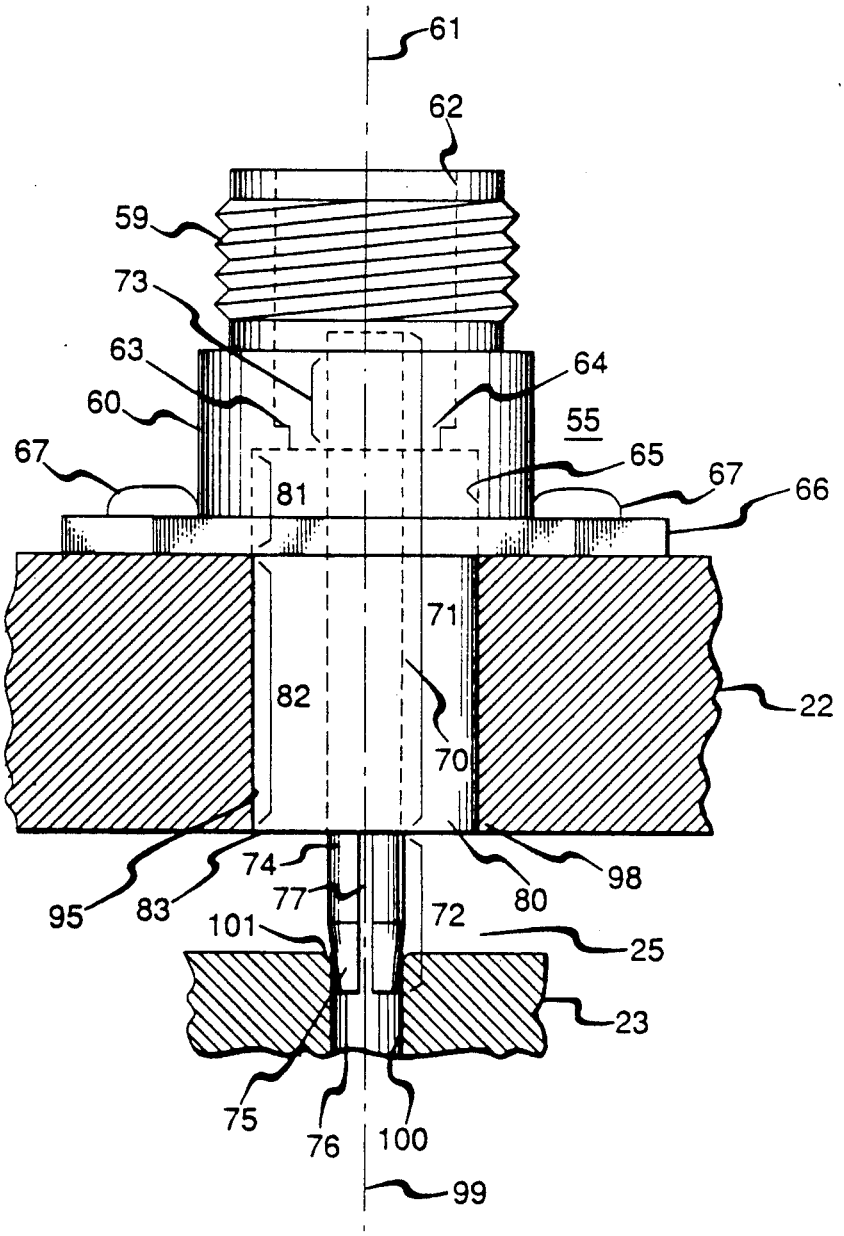
FIG. 2 is an enlarged fragmentary front elevational cross-sectional view of a portion of the FIG. 1 apparatus, FIG. 2 showing in front elevation an exemplary embodiment according to the invention of an input coaxial coupler unit used at the input port of such apparatus, the FIG. 2 unit differing from the coaxial input terminal 27 shown in FIG. 1.
Figure 3:
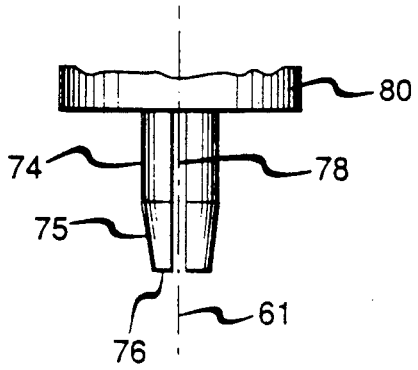
FIG. 3 is a fragmentary right side elevation of a portion of the projecting pin of the FIG. 2 unit.
Figure 4:
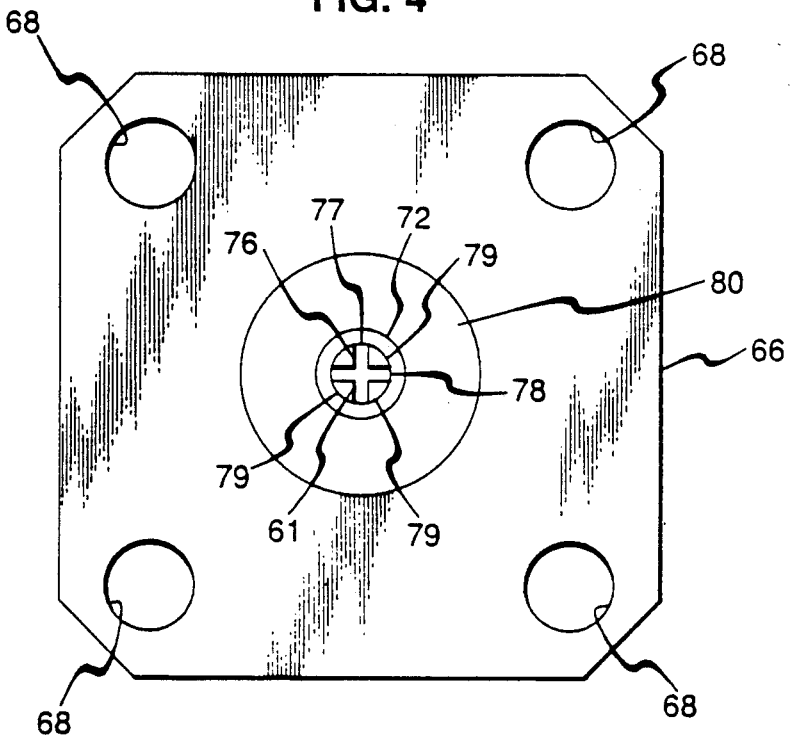
FIG. 4 is a bottom view of the FIG. 2 unit.

Referring now to FIGS. 2–4, the reference numeral 55 generally designates a coaxial coupling unit according to the invention hereof and adapted for use at the input port of the FIG. 1 apparatus in lieu of the coaxial input terminal 27 shown in that figure.

Unit 55 comprises (FIG. 2) a tubular outer aluminum conductor 60 with an axis 61, an axially elongated inner conductor 70 coaxial with outer conductor 60, and a sleeve 80 of a dielectric material such as TEFLON ®, the sleeve being coaxial with and in contact with both of conductors 60 and 70 and maintaining them in fixed spaced coaxial relation.

The conductor 60 has at its top external threading 59 and an upwardly opening socket 62. At the socket's bottom, an annular constriction rib 63 projects radially inward from the socket wall and surrounds a downward passage 64 from the socket to a circular cylindrical chamber 65 within conductor 60 and extending vertically down from rib 63 to the opening of the chamber at the front end of that conductor. Disposed at that front end and integral with the tubular envelope of conductor 60 is a flange 66 extending radially away from such envelope normal to the axis 61 of unit 55. Flange 66 is a mounting flange for unit 55 and, when that unit is installed (as shown in FIG. 2), the flange 66 is secured to the metallic plate member 22 by screws 67 (FIG. 2) passing through holes 68 (FIG. 4) in the flange 66 and then into threaded holes (not shown) formed in such member.

The sleeve 80 is an annular circular cylindrical member having a rear portion 81 and a forward portion 82. Rear portion 81 is snugly fitted in the chamber 65 and is preferably bonded within that chamber to both the outer conductor 60 and the inner conductor 70. Forward portion 82 projects axially forward of the front end of conductor 60. The outside circular cylindrical surface of that forward portion is exposed, i.e., not covered by any sheathing therefor.

The inner conductor 70 is conveniently a beryllium-copper rod having thereon a plating of gold. The conductor over its axial length has first and second sections 71 and 72 which are respectively disposed rearward of and forward of the front end 83 of the sleeve 80. Section 71 of the inner conductor extends vertically up from that front end through and beyond the full length of sleeve 80 and through passage 64 to terminate in a stub 73 upstanding from the top of that sleeve and centrally positioned within socket 62. The threading 59, socket 62 and stub 73 together constitute a conventional jack means for coupling to the input unit 55 the terminal of a flexible coaxial cable (not shown) for supplying high frequency input electromagnetic wave energy to the FIG. 1 apparatus.

The second or forward section 72 of the inner conductor has various features of interest to be later discussed in more detail.

The input coaxial unit 55 is associated in a coaxial-waveguide assemblage with other parts of the described apparatus in a manner as follows.

Referring particularly to FIG. 2, the plate member 22 (providing the upper metallic wall means bounding chamber 25 of the waveguide) has formed therein a circular cylindrical vertical bore 95 coaxial with axis 61 and passing all the way through plate 22. The bore 95 terminates downward in an opening 98 thereof into chamber 25.

Directly below bore 95 there is formed in the plate member 23 (providing the lower metallic wall means bounding chamber 25) a smaller circular cylindrical bore 100 coaxial with bore 95 about axis 61. Bore 100 has a mouth 101 at an opening of such bore into chamber 25, and the bore extends from that opening downward into plate 23 but does not (FIG. 1) pass all the way through the plate. Bore 100 is circular cylindrical in form and has a diameter smaller than the diameter of the uptapered part of the section 72 of pin 70.

Considering now in more detail the pin 72, it has directly below sleeve 80 a stem 74 of circular cylindrical exterior shape and below that stem a tip 75 of frustro-conical-exterior shape. Tip 75 extends downwardly with a convergent taper to the pin's free front end. Pin 72 terminates at that end in a planar circular end face 76 normal to the pin axis 61.

The pin 72 has formed therein a pair of diametrical slots 77 and 78 normal to each other and extending vertically upward in the pin from its front end face 76 through its tip 75 and stem 74 to the pin's upper termination at the front end of dielectric sleeve 80. The two diametrical slots 77, 78 provide in pin 72 a plurality of radial slots extending outward from the pin's axis in planes containing that axis, namely, four such radial slots. Preferably, the pin has formed therein at least three radial slots, but four of them is a convenient number. The pin can include more.

As best shown in FIG. 4 the radial slots in the pin are equiangularly distributed about its axis 61. While those slots need not vertically extend from the pin's front end all the way to its upper termination, increasing insofar as practical the length of those slots is advantageous as later explained.

The slots 77, 78 divide the pin into four axially extending fingers 79 having cross sections normal to the pin axis in the form of circular sectors. All of such fingers 79 are concurrently resiliently deflectable radially inward so that both the tip 75 of the pin and the forward portion of its stem 74 are resiliently compressible radially inward.

Figure 5:
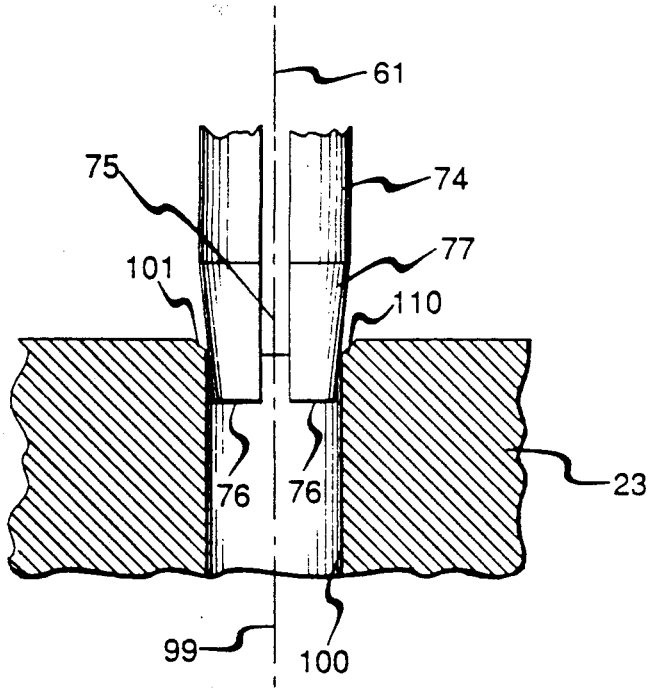
FIG. 5 is a further enlarged fragmentary front elevational view of the front part of the pin of the FIG. 2 unit as inserted in the hole formed in the FIG. 1 apparatus to receive such pin part.
Figure 6:
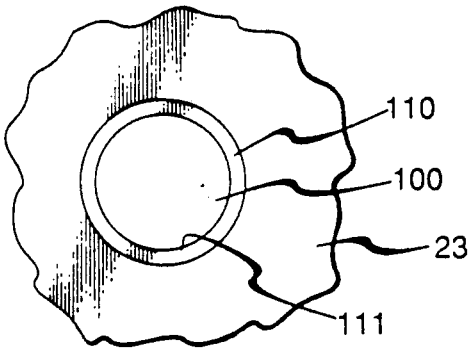
FIG. 6 is a fragmentary plan view of the hole shown in FIG. 5 and of the surroundings of that hole.

Referring now to FIGS. 5 and 6, the wall surface of the bore 100 in plate 23 is shown as including at the plate's mouth 101 an annular chamfer 110 which surrounds the bore and is formed in the plate member to remove any burrs created in drilling bore 100. Such chamfer is preferably no greater in width than is necessary to accomplish that purpose. If desired, chamfer 110 (or other enlarging of bore 100 at its mouth) can be dispensed with, and the bore wall surface can intersect with the top surface of member 23 at a sharp circular edge. As is clear from FIG. 5, bore 100 at the inner edge 111 of chamfer 110 has a diameter greater than that of pin 72 at its front end 76 but lesser than that of such pin at locations along its tapered tip 75 which are rearwardly spaced from that front end.

The spaced metal plates 22, 23 and the bores 95, 100 therein provide a receptacle adapted to have seated therein the lower part of the coupler 55. FIG. 2 depicts the coupler as so seated. As shown in that figure, the unsheathed length of dielectric sleeve 80 is accommodated with a slip fit in bore 95 and extends no further down in that bore than the opening thereof into cavity 25. Since both outer conductor 60 and plate 22 are grounded, the region of plate 22 which walls that bore electrically serves as an extension to cavity 25 of the outer conductor 60.

As further shown, the tip 75 of pin 72 of the coupler is partly inserted into small bore 100 to have a forward portion of such tip extend from the bore's top opening 101 down into the bore. The bore's diameter is less than the diameter of the pin at points therealong in the length of its tip 75. Hence, as the pin tip is being inserted into the bore, the edge 111 of the bore's top opening 101 exerts radially inward force against the pin's fingers 79 to cause resilient deflection radially inward of all such fingers and consequent resilient compression radially inward of the pin tip.

The result of such compression is that the fingers 79 of pin 72 press with yieldable pressure force against metallic regions extending around bore 100 at its mouth 101 along its circular edge 111 to make direct electromechanical contact with those regions and thus with plate 23. Since such contact is a yieldable pressure contact produced by forcible fitting of a leading part of pin 72 into the smaller diameter bore 100, the contact is firm, durable and reliable. The location of the contact between the pin 72 and the plate 23 is exactly, or to a close approximation, at the opening of the bore 100 of the plate 23 into the cavity 25. It has been found that such location for such contact is desirable because such location reduces or eliminates the creation of a.c. impedance anomalies at the point of coupling of the coaxial unit 55 to the splitter cavity 25.

Some other advantages provided by the pin 72 are as follows.

In the event of departure from coaxiality of the axes 61 and 99 of the coupler 55 and bore 100, the taper of the pin tip 75 helps to guide the front part of the pin into that bore as the coupler is being displaced downward to seat it in the two bores 95 and 100. The same taper of pin tip 75 acts in the course of such displacement as a force multiplier. To wit, because of the wedging action provided by the taper, the radially inward deflecting force exerted on the pin fingers 79 by the metallic wall surface regions extending along edge 111 around the bore is a force (for all such fingers) exceeding by several times the downward displacing force on the coupler. Inasmuch as the pin fingers are individually resiliently deflectable by their contacts with such regions, the contact pressure generated between pin 72 and plate member 23 at various points around the pin axis is more uniform than if the pin were to be wholly solid in cross section.

Because of the radially inward resilient compressibility of the pin 72, the coupler 55 may be properly received in the receptacle 95–100 despite minor variations (e.g., tolerance variations) in the vertical spacing between plate members 22 and 23. That is, over a range of variation of such spacing, the coupler may be placed in such receptacle so that sleeve 80 is fully seated in bore 90 and, concurrently, the front of the pin tip 75 is firmly seated in bore 100 to be in good electromechanical contact with member 23 at the mentioned metallic regions. It follows that it is possible by the use of coupler unit 55 to maintain a good electrical coupling between such unit and cavity 25 while deliberately varying such spacing over such range for the purpose of tuning the cavity. That deliberate variation may be effected in the manner disclosed in U.S. patent application Ser. No. 07/472,160 filed on Jan. 30, 1990 in the name of R. E. Myer for "Improved Cavity Means for Microwave Divider-Combiner Units" and assigned to the assignee hereof, such application being incorporated herein by reference and made a part hereof.

As stated earlier, the slots in pin 72 need not extend from its front end 76 all the way up to sleeve 80. There is, however, an advantage in so doing. Considering pin 72 over its length as being a resiliently bendable cantilever beam having its fixed end at sleeve 80, the extension of the slots 77, 78 up to that sleeve increases the pliancy of that beam (i.e., reduces its stiffness) so that its free end is more easily deflectable in both the horizontal dimensions. Such increased pliancy is advantageous for larger departures from coaxiality of the axes 61, 99 of the unit 55 and bore 100 since, in that case, the pin 72 can bend more easily over its length and accommodate such departure while permitting the tip 75 of the pin to more closely approach coaxial alignment with bore 100 to further normal seating of the tip in the bore and a resulting good electrical contact between the pin and plate member 23.

Another advantage of having the described slots in the pin 72 extend a good way up to the sleeve 80 is that the resulting increased pliancy of the pin over its slotted length reduces the sidewise stress exerted by the pin on the unsheathed section 82 of sleeve 80 when, due to misalignment between the axes of the pin and bore 100, the free end of the pin is horizontally deflected in the course of its insertion into such bore. Thus, it is preferable that the slots in the pin extend axially therein from its front end for at least the majority of the overall length of the pin. On the other hand, it is preferable that the slots not extend up in the pin beyond the front end of sleeve section 82 since, if the slots were to extend up beyond that end, the sleeve section would be subject to stress created by the spreading apart of the pin fingers 76. The optimum position of the upper termination of the pin slots is thus a position proximate the front end 83 of the sleeve 80.

Figure 7:
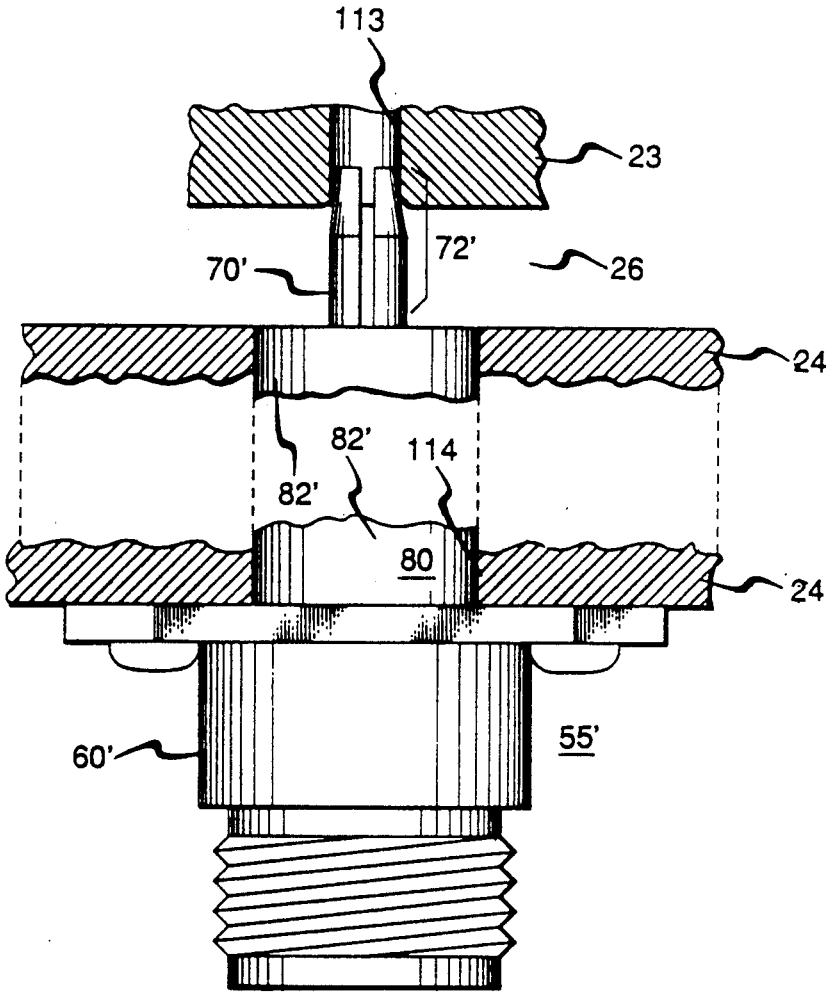
FIG. 7 is an enlarged fragmentary front elevational cross-sectional view of another portion of the FIG. 1 apparatus, FIG. 7 including a view in front elevation of the output coaxial coupler unit.

FIG. 7 is a view of an output coaxial coupler unit 55' disposed at the output port of the apparatus. In that figure, the coupler unit 55' is shown as being seated in a receptacle provided by relatively large and small coaxial bores 114 and 113 formed in, respectively, the metallic plate members 24 and 23 which bound opposite sides of the combiner cavity 26 contained in the apparatus. For convenience of illustration, a part of plate member 24 between its top and bottom surfaces is shown in FIG. 7 as being broken away.

The unit 55' and its elements 60', 70' and 80' shown in FIG. 7 are counterparts of previously described unit 55 and its elements 60, 70 and 80 with the exception that in unit 55' the unsheathed sleeve section 82' of dielectric sleeve 80 is longer than the corresponding sleeve section 82 shown in FIG. 2. Further, the cooperation between unit 55' and plate members 24 and 23 is substantially the same as the cooperation between unit 55 and the plate members 22 and 23. Hence, the previous description of unit 55 and its surroundings shown in FIG. 2 is, unless the context otherwise requires, to be taken as applying equally, *mutatis mutandis*, to the unit 55' and its surroundings shown in FIG. 7.

The above described embodiments being exemplary only, it is to be understood that additions thereto, omissions therefrom and modifications thereof can be made without departing from the spirit of the invention, and that, accordingly, the invention is not to be considered as limited save as is consonant with the recitals of the following claims.

I claim:

1. An assemblage comprising:

a waveguide comprising: first and second vertically spaced metallic walls bounding opposite sides of a wave propagation space providing for horizontal passage between such two walls of high frequency electromagnetic energy, such first and second walls having respectively formed therein relatively large and small vertical coaxial bores of which the large bore passes through said first wall to said wave propagation space, and the small bore extends from such space at least part way through said second wall, a coaxial coupler unit for such energy comprising;

a tubular outer conductor having an axis and a front end, a dielectric sleeve received in said tubular outer conductor, an axially elongated inner conductor disposed in spaced coaxial relation in said tubular conductor and sleeve and having a section disposed forward of the front ends of such tubular conductor and sleeve to provide by such section a pin, said pin having a forward portion which extends axially rearward from the front end of said pin, and said pin being resiliently compressible radially inward over at least the length of such forward portion, said coaxial coupler unit being vertically aligned with the said coaxial bores and having a forward part inserted in such bores so that said sleeve and said pin are respectively received in said large and small bores in such two walls and so that said forward portion of said pin makes direct electric contact with metallic regions of such second wall extending around such small bore and, by such contact, is resiliently compressed radially inwards to cause such contact to be a yieldable pressure contact, said pin comprising a plurality of forward pointing fingers formed by and between a plurality of angularly spaced slots extending radially outward from the axis of said pin and extending axially from the front end of such pin rearwardly to rear terminations of such slots, said fingers being angularly spaced from each other by said slots and being each resiliently deflectable inwards, said pin being shaped to the rear of its front end to taper convergently forward from a pin diameter greater than that of said small bore adjacent its opening into said wave propagation space, to a pin diameter less than that of said bore diameter, and said pin being seated in said small bore so that only part of the tapered length of said pin is inserted in said small bore.

2. An assemblage according to claim 1 in which said slots and fingers extend from the front end of said pin axially rearward beyond such taper in said pin.

3. An assemblage according to claim 2 in which said taper in said pin is forward of a stem section of said pin of substantially constant diameter and disposed between said taper and the front end of said dielectric sleeve, and in which said fingers and slots extend rearwardly through said stem section to rear terminations thereof proximate such front end of said dielectric sleeve.

4. An assemblage according to claim 1 in which said pin at its front end has an end face transverse to the pin axis, and said convergent taper of said pin extends to its front end and is provided by a frusto-conical shaping of at least part of said pin.

* * * * *